US006500301B1

(12) United States Patent
Nilsson

(10) Patent No.: US 6,500,301 B1
(45) Date of Patent: Dec. 31, 2002

(54) APPARATUS FOR GASIFICATION OF SPENT LIQUOR

(75) Inventor: Bengt Nilsson, Skoghall (SE)

(73) Assignee: Chemrec Aktiebolag, Stockholm (SE)

( * ) Notice: Subject to any disclaimer, the term of this patent is extended or adjusted under 35 U.S.C. 154(b) by 0 days.

(21) Appl. No.: 09/937,662

(22) PCT Filed: Mar. 28, 2000

(86) PCT No.: PCT/SE00/00595

§ 371 (c)(1),
(2), (4) Date: Nov. 6, 2001

(87) PCT Pub. No.: WO00/60162

PCT Pub. Date: Oct. 12, 2000

(30) Foreign Application Priority Data

Apr. 1, 1999 (SE) ..... 9901187

(51) Int. Cl.[7] ..... D21C 11/12

(52) U.S. Cl. ..... 162/30.1; 162/31; 422/185; 422/227; 422/228; 422/239

(58) Field of Search ..... 162/30.1, 31; 422/185, 422/227, 228, 239

(56) References Cited

U.S. PATENT DOCUMENTS 5,407,455 A * 4/1995 Nilsson ..... 48/61

5,556,602 A * 9/1996 Nilsson ..... 422/185

FOREIGN PATENT DOCUMENTS

| | | |
|---|---|---|
| CH | 585371 A5 | 2/1977 |
| DE | 3523610 A1 | 3/1986 |
| DE | 19829385 C1 | 10/1999 |
| WO | WO 9429517 A1 | 12/1994 |

* cited by examiner

*Primary Examiner*—Dean T. Nguyen
(74) *Attorney, Agent, or Firm*—Jeffrey S. Melcher; Manelli Denison & Selter PLLC

(57) ABSTRACT

Arrangement for understoichiometric gasification of spent liquor from chemical pulp production, comprising an upper reactor part (2), which upper reactor part is provided with a burner (5) for the spent liquor and with an internally clad reactor jacket (4), and lower separating part (8) for separating a phase of solid and/or molten material, formed on gasification, from a phase of combustible gaseous material. According to the invention, at least the upper reactor part (2), with its clad reactor jacket, is surrounded by an outer vessel (1), with a gap (13) being present between the reactor jacket (4) and the outer vessel (1). Connected to the said gap (13) there are one or more inlets (14) and at least one outlet (21) for a coolant medium.

30 Claims, 1 Drawing Sheet

APPARATUS FOR GASIFICATION OF SPENT LIQUOR

TECHNICAL FIELD

The present invention relates to an arrangement for understoichiometric gasification of spent liquor from chemical pulp production, comprising an upper reactor part, which upper reactor part is provided with a burner for the spent liquor and with an internally clad reactor jacket, and a lower separating part for separating a phase of solid and/or molten material, formed on gasification, from a phase of combustible gaseous material. The arrangement is principally intended for use in conjunction with the recovery of energy and chemicals from an expended cooking liquor from production of chemical paper pulp from a material containing lignocellulose.

PRIOR ART AND PROBLEM

For many years, the commercially dominant process for recovering energy and chemicals from so-called black liquor, which has been obtained in paper pulp production by the sulphate method, has generally been the so-called Tomlinson process, also called a recovery boiler.

A more modern process is described in Swedish Patent SE-C-448,173, which process is based on understoichiometric gasification/pyrolysis (i.e. with an oxygen deficit) of the black liquor in a reactor. The products are in this case a phase of solid and/or molten material, essentially comprising sodium carbonate, potassium hydroxide and sodium sulphide, and an energy-rich, combustible gas phase, essentially comprising carbon monoxide, carbon dioxide, methane, hydrogen gas and hydrogen sulphide. The mixture of solid/molten phase and gas phase is cooled and separated in a separating part connected to the reactor by means of direct contact with green liquor, the solid/molten phase dissolving in the green liquor. The green liquor is then conveyed for conventional causticizing for production of white liquor. The gas phase is used as fuel for generating steam and/or electrical power.

The reactor in the process/arrangement according to abovementioned SE-C-448,173 consists of a vessel which is internally clad/lined with a ceramic material. Other known reactors of the same construction type are shown, for example, in WO94/20677, WO93/02249 and WO93/24704. The separating part is usually arranged so that its outer walls constitute a continuation of the vessel for the reactor, the ceramic cladding of the reactor being arranged to present a cone-shaped constriction between the reactor and the separating part.

A problem with this known construction type for reactors is that in the event of uncontrolled expansion of the ceramic lining, for example caused by thermal expansion or diffusion of materials, these forces are transmitted to the walls of the pressure vessel. The ceramic lining has an ability to absorb inorganic material in the form of very small molten particles. These particles have been found to be able to reach through the reactor lining and then crystallize in an outer layer thereof, whereupon the lining is expanded. Uncontrolled expansion causes stresses in, and shortens the lifetime of, both the pressure vessel and the ceramic lining. Another problem is that changing the ceramic lining when it becomes worn is difficult because the ceramic material has to be removed without damaging the pressure vessel.

Further disadvantages/problems with the known construction type are heat losses from the reactor via the ceramic lining and the vessel walls, which losses are not used in the process.

CH 585,371 discloses a combustion arrangement or complete combustion of spent liquids, comprising a reactor part and a quench. The reactor part is in this case surrounded by an outer vessel, and there is a gap between the reactor part and the outer vessel, in which gap a coolant liquid is circulated in a closed circulation. The coolant liquid consists of a liquid which is entirely separate from the rest of the system, i.e. without direct contact with either gas phase or liquid phase in reactor and quench.

WO97/37944 also discloses a combustion arrangement for complete combustion of spent liquids, comprising a reactor part and a quench, and with a gap between the reactor part and an outer vessel. A coolant liquid is circulated in the gap, which coolant liquid is entirely separate from the rest of the system and is in part evaporated. It is also noted that the reactor in this embodiment is not lined.

DESCRIPTION OF THE INVENTION

The object of the present invention is to reduce or eliminate the abovementioned problems by making available an arrangement for understoichiometric gasification of spent liquor from chemical pulp production, where the reactor part constitutes an exchangeable prefabricated unit and where a favourable temperature profile in the reactor wall is obtained. At the same time, the heat losses are reduced and the heat transmission which takes place in the reactor part is utilized and increases the partial steam pressure of the water. This means that steam generation is improved, by about 5 to 10%, in subsequent condensation stages for gas cooling, which improves the economics of the process.

The arrangement according to the invention is defined in Patent claim 1.

According to the invention, the internally clad reactor part is surrounded by an outer vessel, with a gap between the said reactor jacket and the said outer vessel. Connected to the gap there are one or more inlets for a coolant medium, preferably a coolant liquid which preferably consists of a condensate which, in the process, is in direct contact with at least the gas phase of combustible material formed in the process.

As there is direct contact and direct connection between gas phase and condensate used as coolant medium, this means that essentially the same pressure is present inside the reactor as in the gap between the reactor and the outer vessel. By this means, the reactor part does not need to be designed as a pressure vessel, and it is sufficient for the outer vessel to be designed as a pressure vessel. The reactor part is thus comparatively simple and can be easily replaced on operational shutdown by means of the fact that the outer vessel can be opened so that the reactor part can be lifted out of this and replaced with a prefabricated unit.

In the gap, the temperature is preferably the saturation temperature at the prevailing pressure, the coolant liquid being partially evaporated. The heat taken up in the coolant liquid can be utilized for production of steam, preferably low-pressure or medium-pressure steam.

The upper reactor part with ceramic lining is connected to a lower separating part cooled by a film of liquid, in which separating part smelt and combustion gas are separated. However, a considerable number of the reactions also take place in the separating part, which affords an extended reaction space. However, in the following description, this lower part is referred to only with respect to the separating stage.

By virtue of the fact that the ceramic lining is cooled by the coolant liquid, a favourable temperature gradient is obtained between the inner surface of the reactor jacket and its outer surface, and inorganic material which has migrated into the ceramic will crystallize/freeze before it reaches the outer surface of the lining. A temperature corresponding to the freezing point of alkali will be present in the reactor lining at a predetermined depth.

By means of the continuous external sprinkling of coolant liquid, the positioning of this freezing point can be controlled in an optimum and controlled manner over the whole of the reactor vessel.

According to one aspect of the invention, the reactor operates at a pressure of 1.5–150 bar (abs.), preferably 1.5–50 bar, although atmospheric pressure is also conceivable. The temperature in the reactor can be 500–1600° C., preferably 700–1300° C., and the temperature gradient over the reactor jacket will thus range from the reactor temperature on the inside to the saturation temperature at the prevailing pressure.

DESCRIPTION OF THE FIGURE

The invention will be described below on the basis of a preferred embodiment and with reference to FIG. 1 which shows an arrangement according to the said embodiment.

Figure 1:
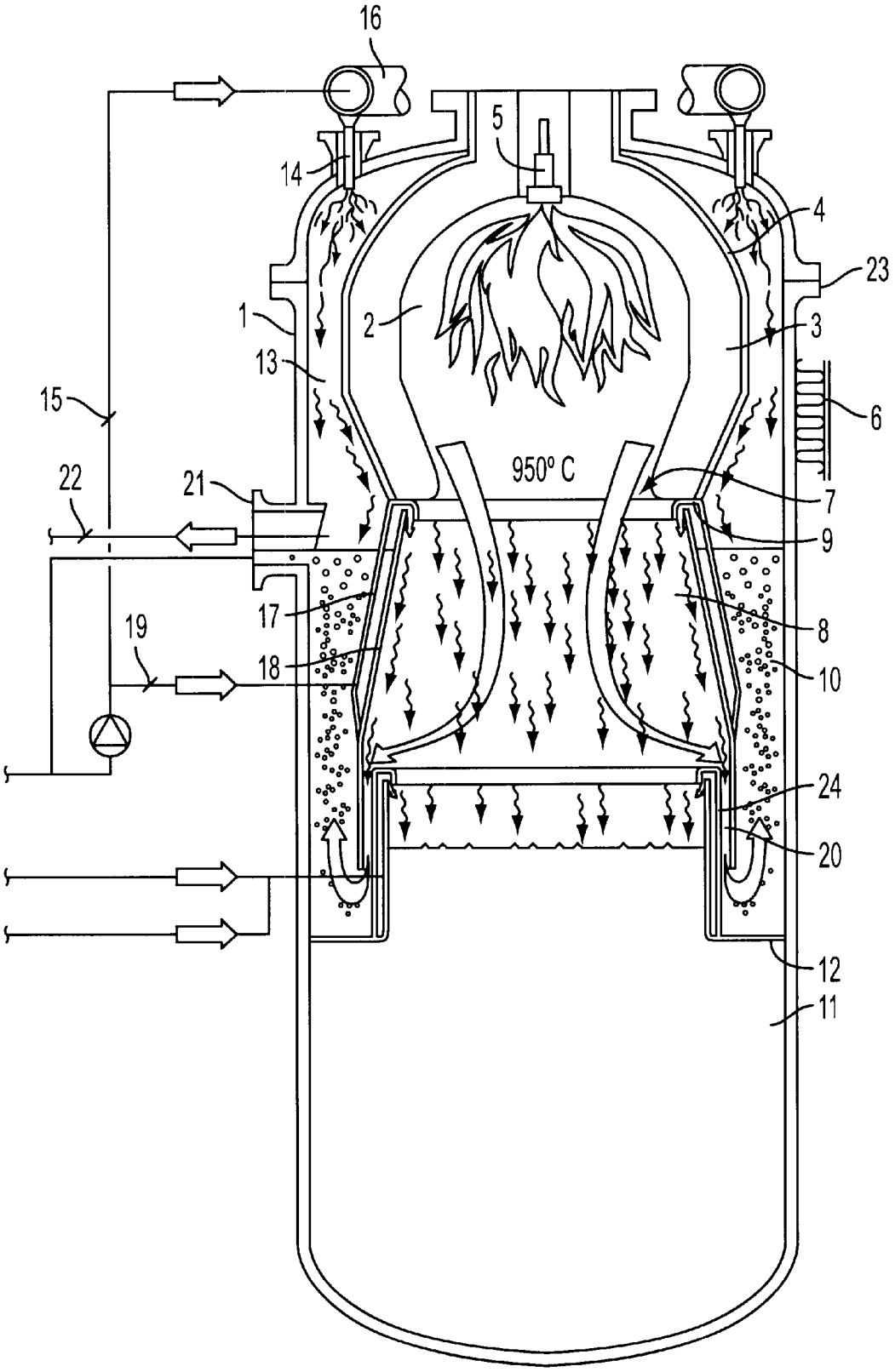
FIG. 1 shows a pressure vessel 1 made of pressure-vessel steel and adapted for a pressure of 35 bar at a maximum temperature of about 280° C. There is an insulation 6 covering the pressure vessel 1. Arranged inside the pressure vessel 1, there is an upper reactor part 2 which consists of a cassette 4 of sheet metal, with a ceramic lining 3.

The pressure vessel 1 can be divided at the flange pair indicated by 23, which means that when operations are halted, the vessel can be opened relatively easily for inspection and for changing the prefabricated reactor part 2 if so required, for example when the lining 3 has become worn. Lifting eye bolts (not shown) are in this case preferably arranged on the upper end wall of the reactor part.

A burner 5 for black liquor is arranged at the top of the reactor part 1, connected to inlets (not shown) for black liquor and oxygen gas and/or another oxygen-containing gas such as air. The reactor part has, at the bottom, an opening 7 which preferably has an open area of at least 40% of the greatest internal area of the reactor part in the horizontal plane.

The ceramic lining is either supported at the lower edge by separate brackets (not shown) or supported to some degree by the upper edge 9 of the separating part 8. The brackets can preferably be secured to the walls of the pressure vessel 1. The support structure of the upper part of the reactor can thus be independent of the separating part of the reactor, or alternatively integrated in the separating part.

Arranged outside the separating part 8, there is a condensate bath 10. In the embodiment shown, the condensate bath 10 is accommodated in the same vessel 1 as well as the reactor part 2, the separating part 8 and a green liquor bath 11. The green liquor bath 11 here lies under the condensate bath 10, these baths being separated by a dividing wall 12.

There is a gap 13 between the pressure vessel 1 and the jacket of the reactor part 2. In this gap 13, the pressure is essentially the same as in the reactor, namely 35 bar, and the temperature is about 240° C., which corresponds to the saturation temperature at 35 bar. Connected to the gap, there is an inlet 14 for a coolant medium, in the embodiment shown a coolant liquid which consists of condensate from the condensate bath 10. This coolant liquid is supplied to the gap 13 via a supply line 15 with a pump (not shown) belonging to a subsequent operational stage for gas cooling, preferably by way of a countercurrent condenser, ending in an annular line 16 with a number of outlets, preferably 4 to 12 outlets and most preferably 6 to 10 outlets, which constitute the inlets 14 to the gap. The inlets 14 are also arranged level with, or immediately above, the upper end of the reactor part 2, so that coolant liquid sprayed in is caused to sprinkle the reactor part, with formation of a cooling, evaporating liquid film on the cassette plate 4, but also on the inside of the pressure vessel.

The inlets can also be provided with certain spray devices or nozzles which distribute the coolant liquid radially towards the centre of the reactor and towards the inside of the pressure vessel. The coolant liquid film also flows across the upper part of the separating part 8, i.e. that part which partly supports the lining 3, and cools it, and then falls back down into the condensate bath 10. The condensate bath 10 has a liquid surface which preferably lies under the lower part of the reactor part 2. Condensate from the condensate bath 10 is also used for further cooling the separating part 8, with condensate being supplied to the separating part 8, more precisely to the intermediate space between two concentric cylindrical plates 17, 18 of upwardly narrowing cross section, via a second supply line 19 which is in communication with the supply line 15. The condensate fills the space between the two plates 17, 18 and, via a spillway 9, forms a liquid film on the inside of the inner plate 18, after which it flows back out into the condensate bath 10.

The actual gasification process is known per se and will not be described in detail, but the principle is that black liquor is gasified essentially in the reactor part 2 and partly in the separating part 8, at a pressure of 35 bar and at a temperature of about 950° C., with formation of a phase of solid and/or molten material and a gas phase of combustible material. The solid/molten phase falls straight down into the green liquor bath 11 under its own weight and is dissolved there, while the gas phase is forced out into a gap 20 between the downward extension of the plate 18, or 17, and an inwardly lying cylindrical plate 24 which, at the lower edge, is joined in a sealed manner to the dividing wall 12. The green liquor bath 11 lies to the inside of the cylindrical plate 24 and under the dividing wall 12. Contact is as far as possible avoided between gas phase and green liquor bath. The gas phase continues through the gap 20 and is then forced to bubble through the condensate bath 10, whereupon any particles entrained in the gas are dissolved in the condensate and the gas is thus washed and saturated with moisture. The hot, humidified gas then reaches the gap 13 and is then drawn off through an outlet 21 in the pressure vessel 1. In the embodiment shown, there is a common outlet 21 for gas and recirculating condensate. In an alternative embodiment, separate outlets can be provided, in which case a gas outlet can be arranged in or at the upper part of the pressure vessel 1. The gas passes via a line 22 onwards for energy recovery in the form of steam and/or electrical power (gas and steam turbine) and condensate passes via the supply lines 15, 19 back to the arrangement for cooling.

The invention is not limited to the embodiment described above, and can be modified within the scope of the attached patent claims. For example, the arrangement can be used in understoichiometric gasification of spent liquors other than conventional black liquor, for example spent sulphite liquors, spent bleaching liquors or black liquor with potassium base. In addition, the green liquor bath can be replaced by a white liquor bath when the process is designed to avoid causticizing and instead directly produce a white liquor with high sulphidity, for example according to WO91/08337 or EP 617 747.

The condensate bath 10 does not necessarily have to the accommodated in the vessel 1 but can be arranged in a separate vessel, for example according to WO95/35410, where the gas phase is driven from the reactor outlet to a counter-current falling-film condenser with a condensate bath in the lower part, through which condensate bath the gas is forced to bubble. The arrangement according to the invention can also be designed such that the gas is not allowed to bubble through the condensate bath.

The invention can also be used in conjunction with a system of two or more reactors, in which case any condensate movement/coolant liquid movement can be coordinated in an optimum manner. It will also be appreciated that the separating part and green liquor bath can be designed in other ways without departing from the concept of the invention.

In its widest aspect, the coolant liquid does not need to consist of a condensate in the system or even of a coolant liquid, as long as Patent claim 1 is satisfied, the problems set out in the list of problems defined hereinabove being reduced or eliminated.

Alternative coolant medium can consist, for example, of used cooking liquor, often called thin liquor or black liquor.

What is claimed is:

1. Arrangement for understoichiometric gasification of spent liquor from chemical pulp production comprising:

an upper reactor part comprising a burner for spent liquor and an internally clad reactor jacket;

a lower separating part in communication with the upper reactor part and being constructed and arranged for separating a phase comprising solid and/or molten material from a phase comprising combustible gaseous material which are formed during gasification in the upper reactor part;

an outer vessel surrounding at least the upper reactor part, the upper reactor part and the outer vessel defining a gap therebetween;

one or more inlets and at least one outlet for a coolant medium being in communication with the gap, the inlets being arranged near a highest point of the gap that is level with or above an upper end of the upper reactor part;

a condensate bath disposed in or near the arrangement and in communication with the separating part and being constructed and arranged to collect a condensate from the separating part;

a first supply line in communication with the inlet and in communication with the condensate bath for supplying coolant liquid in the form of condensate to the inlet; and a liquid bath separate from the condensate bath in communication with the lower part and being constructed and arranged to collect the solid and/or molten material, wherein the arrangement is constructed and arranged such that during operation a phase of combustible gaseous material is conveyed from the upper reactor part via the lower separating part through the condensate bath or through a spray curtain of condensate that is collected in the condensate bath, while the phase of solid and/or molten material is conveyed to the liquid bath.

2. Arrangement according to claim 1, wherein the inlets are evenly distributed around a periphery of the upper reactor part.

3. Arrangement according to claim 1, further comprising a second supply line in communication with the condensate bath and with the lower separating part for cooling and protecting the lower separating part.

4. Arrangement according to claim 1, wherein the outer vessel is constructed such that the outer vessel and the upper reactor part define the gap axially over the whole reactor part.

5. Arrangement according to claim 4, wherein an outlet for the phase of combustible gaseous material is arranged in the outer vessel at a level under the reactor part.

6. Arrangement according to claim 1, wherein the outer vessel also extends over the whole separating part and the liquid bath.

7. Arrangement according to claim 1, wherein the condensate bath is at least partially defined by a space between the separating part and the outer vessel.

8. Arrangement according to claim 7, wherein an outlet for the condensate is disposed in the outer vessel at a location under the reactor part.

9. Arrangement according to claim 1, wherein the outer vessel comprises a pressure vessel.

10. Arrangement according to claim 1, wherein the outer vessel is arranged to be able to be opened for inspection.

11. Arrangement according to claim 8, wherein the outer vessel is arranged to be able to be opened for inspection and replacement of the clad reactor part.

12. Arrangement according to claim 1, wherein the clad reactor part comprises a prefabricated unit made in one piece.

13. Arrangement according to claim 1, wherein the inlets are constructed and arranged such that during operation the inlets continuously sprinkle the outside of the reactor part with the coolant medium.

14. Arrangement according to claim 13, wherein the inlets are constructed and arranged such that during operation the inlets continuously sprinkle the outside of the reactor part and an inside of the pressure vessel with the cooling medium.

15. Arrangement according to claim 13, wherein the inlets are constructed and arranged such that during operation the inlets continuously sprinkle the outside of the reactor part and an external upper portion of the separating part lying above the condensate bath with the said coolant medium.

16. Arrangement according to claim 1, wherein the inlets are evenly distributed around a periphery of the upper reactor part and 4 to 12 of the inlets are provided.

17. Arrangement according to claim 1, wherein the inlets are evenly distributed around a periphery of the upper reactor part and 6 to 10 of the inlets are provided.

18. Arrangement according to claim 1, further comprising a second supply line in communication with the first supply line and with the lower separating part for cooling and protecting the lower separating part.

19. Arrangement for understoichiometric gasification of spent liquor from chemical pulp production comprising:

a removable upper reactor part comprising a burner for spent liquor and an internally clad reactor jacket;

a lower separating part in communication with the upper reactor part and being constructed and arranged for separating a phase comprising solid and/or molten material from a phase comprising combustible gaseous material which are formed during gasification in the upper reactor;

an outer pressure vessel surrounding at least the upper reactor part, the upper reactor part and the outer vessel defining a gap therebetween, and the outer vessel having an opening constructed and arranged for replacing the upper reactor part;

one or more inlets being in communication with the gap and constructed and arranged to supply a cooling medium to an outer surface of the upper reactor part to cool the upper reactor part;

a condensate bath constructed and arranged to collect at least a part of the cooling medium contacting the outer surface of the upper reactor part;

a first supply line in communication with the inlet and in communication with the condensate bath for supplying coolant liquid in the form of condensate to the inlet; and a liquid bath separate from the condensate bath in communication with the lower part and being constructed and arranged to collect the solid and/or molten material.

20. Arrangement according to claim 19, further comprising a passage from the lower separating part that opens into the condensate bath such that during operation the phase of combustible gaseous material leaves the lower separating part through the passage, enters a liquid present in the condensate bath and bubbles up through the liquid present in the condensate bath.

21. Arrangement according to claim 20, wherein the lower separating part is constructed such that at least a portion of a liquid present on an inner surface of the lower separating part during operation travels to the condensate bath.

22. Arrangement according to claim 19, wherein the condensate bath is defined by the outer pressure vessel and lower separating part such that liquid present on an inside surface of the outer pressure vessel is collected in the condensate bath and the condensate bath cools the lower separating part during operation.

23. Arrangement according to claim 22, wherein the condensate bath is constructed such that during operation an upper liquid level in the condensate bath is below the upper reactor part.

24. Arrangement according to claim 19, wherein the outer vessel is constructed to contain a pressure in the range of 1.5 to 150 barr at a temperature in the range of 500 to 1600° C.

25. Arrangement according to claim 19, wherein the upper reactor part is constructed of sheet metal.

26. Arrangement according to claim 19, further comprising a plate disposed between the outer vessel and the lower separating part, wherein the lower separating part and plate are constructed such that during operation liquid from the condensate bath can flow between the plate the lower separating part and into the lower separating part to form a liquid film on an inside surface of the lower separating part.

27. Arrangement according to claim 19, wherein the upper reactor part and the lower reactor part are cylindrical.

28. Arrangement according to claim 19, wherein the upper reactor part has an opening of at least 40% of the greatest internal area of the upper reactor part in a horizontal plane.

29. Arrangement according to claim 19, wherein the outer pressure vessel contains the whole lower separating part.

30. Arrangement according to claim 19, wherein the outer pressure vessel contains the whole liquid bath.

* * * * *